US010511905B2

(12) United States Patent
Liu et al.

(10) Patent No.: US 10,511,905 B2
(45) Date of Patent: Dec. 17, 2019

(54) METHOD AND SYSTEM FOR DYNAMICALLY ENHANCING LOW FREQUENCY BASED ON EQUAL-LOUDNESS CONTOUR

(71) Applicant: SHENZHEN GRANDSUN ELECTRONIC CO., LTD., Shenzhen (CN)

(72) Inventors: Yuyun Liu, Shenzhen (CN); Xinlong Peng, Shenzhen (CN); Haiquan Wu, Shenzhen (CN); Ruiwen Shi, Shenzhen (CN)

(73) Assignee: SHENZHEN GRANDSUN ELECTRONIC CO., LTD., Shenzhen (CN)

( * ) Notice: Subject to any disclaimer, the term of this patent is extended or adjusted under 35 U.S.C. 154(b) by 11 days.

(21) Appl. No.: 15/647,138

(22) Filed: Jul. 11, 2017

(65) Prior Publication Data

US 2017/0311078 A1 Oct. 26, 2017

Related U.S. Application Data

(63) Continuation of application No. PCT/CN2015/087581, filed on Aug. 20, 2015.

(30) Foreign Application Priority Data

Mar. 23, 2015 (CN) ..... 2015 1 0127703

(51) Int. Cl.
*H04R 3/04* (2006.01)
*H04R 29/00* (2006.01)

(52) U.S. Cl.
CPC ..... *H04R 3/04* (2013.01); *H04R 29/001* (2013.01); *H04R 2430/01* (2013.01)

(58) Field of Classification Search
CPC ..... H03G 9/025; H03G 7/002
See application file for complete search history.

(56) References Cited

U.S. PATENT DOCUMENTS 5,046,105 A * 9/1991 Bohn ..... H03G 5/12 333/28 T
5,172,358 A * 12/1992 Kimura ..... H03G 5/005 369/47.26

(Continued)

FOREIGN PATENT DOCUMENTS

CN 101166018 A 4/2008
CN 102378085 A 3/2012

(Continued)

OTHER PUBLICATIONS

RETIFWEB Compandeur, Wayback Machine Feb. 18, 2015, see English translation.*

*Primary Examiner* — Kile O Blair
(74) *Attorney, Agent, or Firm* — Robert L. Stearns; Dickinson Wright PLLC

(57) ABSTRACT

A method comprises: collecting an input audio signal; performing frequency-division processing on the input audio signal, extracting a high-frequency signal and a low-frequency signal to transmit respectively, and reserving one path of original audio signal; performing dynamic gain processing on the low-frequency signal adopting an Automatic Gain Control (AGC) algorithm, and performing low-pass filtering enhancement processing on the original audio signal adopting a static low-frequency enhancement algorithm; and subjecting the high-frequency signal, the processed low-frequency signal and the processed original audio signal to weighted summation to obtain a final output audio signal, the weight coefficients of the high frequency signal, the processed low-frequency signal and the processed original audio signal being a, b and c respectively, (Continued)

where the values of a, b and c range from 0 to 1, and a+b+c=1.

12 Claims, 3 Drawing Sheets

(56) References Cited

U.S. PATENT DOCUMENTS

| | | | | |
|---|---|---|---|---|
| 9,413,322 | B2 * | 8/2016 | Soulodre | H03G 5/005 |
| 2002/0076072 | A1 * | 6/2002 | Cornelisse | H03G 7/007 381/312 |
| 2005/0094828 | A1 * | 5/2005 | Sugimoto | H03G 5/165 381/98 |

FOREIGN PATENT DOCUMENTS

| | | | |
|---|---|---|---|
| CN | 102547531 | A | 7/2012 |
| JP | 08336088 | A | 12/1996 |

* cited by examiner

METHOD AND SYSTEM FOR DYNAMICALLY ENHANCING LOW FREQUENCY BASED ON EQUAL-LOUDNESS CONTOUR

TECHNICAL FIELD

The disclosure relates to the field of audio signal processing technologies, and in particular to a method for dynamically enhancing a low frequency based on equal-loudness contour and a system for dynamically enhancing a low frequency based on equal-loudness contour.

BACKGROUND

Audio stream output by earphone can be viewed as the superposition of many sine waves of different frequencies; low-frequency enhancement is to improve the sound pressure level of low-frequency components in the audio stream by filtering and other methods, so that the voice sounds more vigorous.

The low-frequency enhancement in existing technologies mainly adopts filter technologies, and combines different filters and other components to meet different requirements. However, adopting pure filter technologies to perform low-frequency enhancement has certain limitation: it is cumbersome to adjust voice volume (actually to amplify/reduce the amplitude of the waveform of an audio signal so as to change the sound pressure) in the normal use of earphone, it can be known from the description of an equal-loudness contour that pure tones of different frequencies have different loudness at different sound pressure levels; therefore, in actual application, when low-frequency enhancement is performed on the audio stream output by an earphone, different gains need to be added to signals of different frequencies at different sound pressure levels, so that gains of signals of different frequencies in the output audio signal all meet the tendency of the equal-loudness contour when voice volume is adjusted and an optimal low-frequency enhancement effect is achieved; however, this requirement cannot be met in static filter combination in existing technologies.

SUMMARY

The purpose of the embodiment of the disclosure is to provide a system and a method for dynamically enhancing a low frequency based on equal-loudness contour so as to solve the above problem that different gains cannot be added to signals of different frequencies at different sound pressure levels in static filter combination.

The embodiment of the disclosure is realized as follows: a method for dynamically enhancing a low frequency based on equal-loudness contour includes:

collecting an input original audio signal;

extracting a high-frequency signal and a low-frequency signal from the input original audio signal through frequency division to transmit respectively, and reserving one duplicate signal of the original audio signal;

performing dynamic gain processing on the low-frequency signal adopting an AGC algorithm, and performing low-pass filtering for the original audio signal and enhancing the filtered original audio signal adopting a static low-frequency enhancement algorithm; and subjecting the high-frequency signal, the processed low-frequency signal and the processed original audio signal to weighted summation to obtain a final output audio signal, the weight coefficients of the high frequency signal, the processed low-frequency signal and the processed original audio signal being a, b and c respectively, where the values of a, b and c range from 0 to 1, and a+b+c=1.

In the method for dynamically enhancing a low frequency based on equal-loudness contour described in the embodiment of the disclosure, performing dynamic gain processing on the low-frequency signal adopting an AGC algorithm specifically includes:

detecting the sound pressure level of the low-frequency signal;

determining the range in which the sound pressure level falls in;

if the sound pressure level is in a noise domain, performing zero gain processing on the low-frequency signal; if the sound pressure level is in a general signal domain, performing gain amplification processing on the low-frequency signal, thereby the sound pressure level of the low-frequency signal infinitely closes to an expected sound pressure domain or enters the expected sound pressure domain; if the sound pressure level is in the expected sound pressure domain, controlling the gain of the low-frequency signal by controlling a gain coefficient, thereby the sound pressure level of the low-frequency signal is kept in the expected sound pressure domain; if the sound pressure level is greater than the expected sound pressure domain, performing negative gain processing on the low-frequency signal, thereby the sound pressure level of the low-frequency signal enters the expected sound pressure domain.

In the method for dynamically enhancing a low frequency based on equal-loudness contour described in the embodiment of the disclosure, the range of the sound pressure level of the noise domain is less than or equal to −80 dB(A), the range of the sound pressure level of the general signal domain is −80 dB(A) to −56 dB(A), and the range of the sound pressure level of the expected sound pressure domain is −56 dB(A) to 24 dB(A).

In the method for dynamically enhancing a low frequency based on equal-loudness contour described in the embodiment of the disclosure, the weight coefficients a, b, c of the high frequency signal, the processed low-frequency signal and the processed original audio signal all have a value of ⅓.

In the method for dynamically enhancing a low frequency based on equal-loudness contour described in the embodiment of the disclosure, the low-frequency signal is a low-frequency band signal with frequency less than or equal to 130 HZ in the input original audio signal, and the high-frequency signal is a high-frequency band signal with frequency greater than or equal to 1500 HZ in the input original audio signal.

Another purpose of the embodiment of the disclosure is to provide a system for dynamically enhancing a low frequency based on equal-loudness contour, including: an audio sampling module, a frequency division module, a low-frequency bandpass filter, a high-frequency bandpass filter, an original audio bandpass filter, an AGC module, a filtering and enhancing module and a mixer; an input end, a low-frequency output end, a high-frequency output end and an original audio output end of the frequency division module are respectively connected to the audio sampling module, the low-frequency bandpass filter, the high-frequency bandpass filter and the original audio bandpass filter correspondingly; the low-frequency bandpass filter is further connected to the mixer through the AGC module, the high-frequency bandpass filter is directly connected to the mixer, and the original audio bandpass filter is connected to the mixer through the filtering and enhancing module; wherein the audio sampling module is configured to collect an input original audio signal;

the frequency division module is configured to extract a high-frequency signal and a low-frequency signal from the input original audio signal through frequency division to transmit respectively through the low-frequency bandpass filter and the high-frequency bandpass filter, and reserve one duplicate signal of original audio signal to transmit through the original audio bandpass filter;

the AGC module is configured to perform dynamic gain processing on the low-frequency signal adopting an AGC algorithm;

the filtering and enhancing module is configured to perform low-pass filtering for the original audio signal and enhance the filtered original audio signal adopting a static low-frequency enhancement algorithm; and the mixer is configured to subject the high-frequency signal, the processed low-frequency signal and the processed original audio signal to weighted summation to obtain a final output audio signal, the weight coefficients of the high frequency signal, the processed low-frequency signal and the processed original audio signal being a, b and c respectively, where the values of a, b and c range from 0 to 1, and a+b+c=1.

In the system for dynamically enhancing a low frequency based on equal-loudness contour described in the embodiment of the disclosure, the AGC module includes:

a sound pressure level detection unit configured to detect the sound pressure level of the low-frequency signal;

a comparison unit configured to determine the range in which the sound pressure level falls in; and a gain adjustment unit configured to: if the sound pressure level is in a noise domain, perform zero gain processing on the low-frequency signal; if the sound pressure level is in a general signal domain, perform gain amplification processing on the low-frequency signal, thereby the sound pressure level of the low-frequency signal infinitely closes to an expected sound pressure domain or enters the expected sound pressure domain; if the sound pressure level is in the expected sound pressure domain, control the gain of the low-frequency signal by controlling a gain coefficient, thereby the sound pressure level of the low-frequency signal is kept in the expected sound pressure domain; if the sound pressure level is greater than the expected sound pressure domain, perform negative gain processing on the low-frequency signal, thereby the sound pressure level of the low-frequency signal enters the expected sound pressure domain.

In the system for dynamically enhancing a low frequency based on equal-loudness contour described in the embodiment of the disclosure, the range of the sound pressure level of the noise domain is less than or equal to −80 dB(A), the range of the sound pressure level of the general signal domain is −80 dB(A) to −56 dB(A), and the range of the sound pressure level of the expected sound pressure domain is −56 dB(A) to 24 dB(A).

In the system for dynamically enhancing a low frequency based on equal-loudness contour described in the embodiment of the disclosure, the weight coefficients a, b, c of the high frequency signal, the processed low-frequency signal and the processed original audio signal all have a value of ⅓.

In the system for dynamically enhancing a low frequency based on equal-loudness contour described in the embodiment of the disclosure, the low-frequency signal is a low-frequency band signal with frequency less than or equal to 130 HZ in the input original audio signal, and the high-frequency signal is a high-frequency band signal with frequency greater than or equal to 1500 HZ in the input original audio signal.

The method and system for dynamically enhancing a low frequency based on equal-loudness contour provided by the embodiment of the disclosure have benefits as follows:

The embodiment of the disclosure first extracts a high-frequency signal and a low-frequency signal from the input audio signal after collecting the input original audio signal to transmit respectively, and reserves one duplicate signal of original audio signal; then performs dynamic gain processing on the low-frequency signal adopting an AGC algorithm, and performs low-pass filtering for the original audio signal and enhance the filtered original audio signal adopting a static low-frequency enhancement algorithm; and finally subjects the high-frequency signal, the processed low-frequency signal and the processed original audio signal to weighted summation to obtain a final output audio signal, the weight coefficients of the high frequency signal, the processed low-frequency signal and the processed original audio signal being a, b and c respectively, where the values of a, b and c range from 0 to 1, and a+b+c=1. Thus, different gains can be added to signals of different frequencies at different sound pressure levels, so that gains of signals of different frequencies in the output audio signal all meet the tendency of a equal-loudness contour when voice volume is adjusted, an optimal low-frequency enhancement effect can be achieved, and the stability of the low-frequency enhancement effect can be ensured.

DESCRIPTION OF THE EMBODIMENTS

To make the purpose, technical scheme and advantages of the disclosure more clearly understood, the disclosure is described in further detail below in conjunction with accompanying drawings and embodiments. It should be understood that the specific embodiments described below are merely to illustrate, but not to limit, the disclosure.

Figure 1:
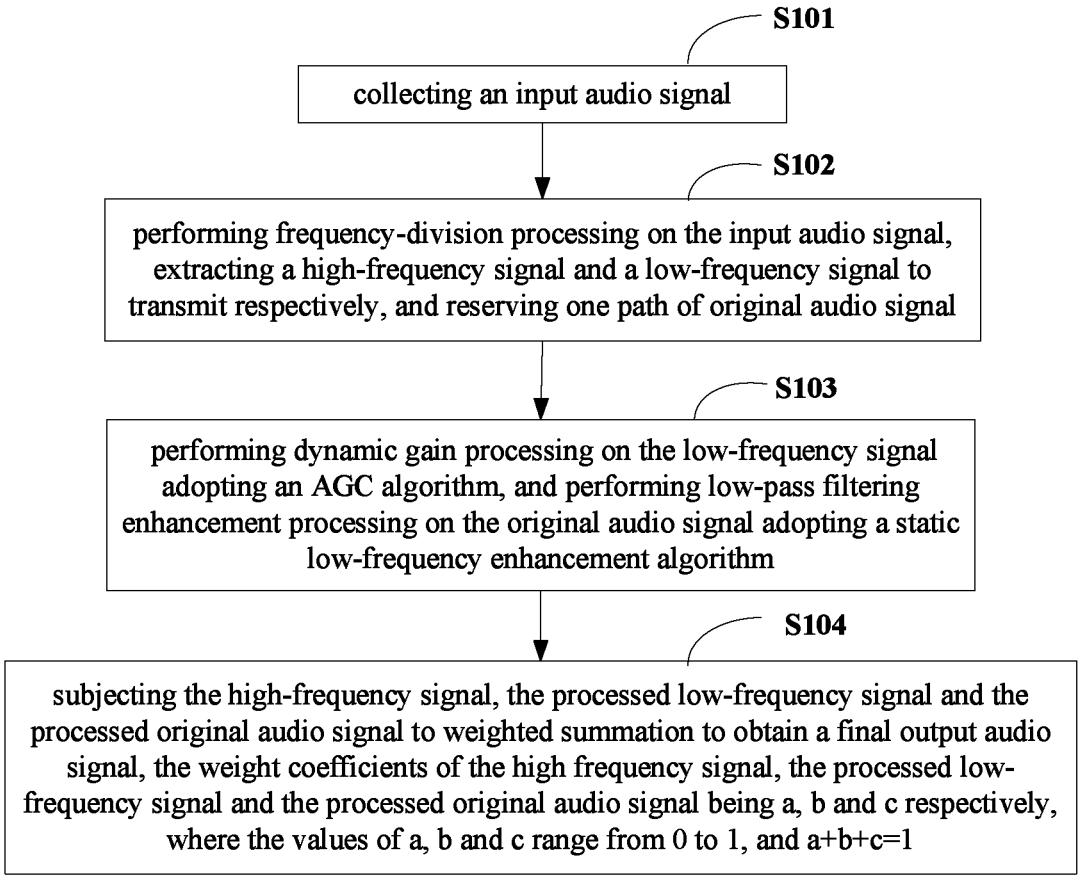
FIG. 1 is a flowchart of a method for dynamically enhancing a low frequency based on equal-loudness contour provided by the embodiment of the disclosure.

FIG. 1 is a flowchart of a method for dynamically enhancing a low frequency based on equal-loudness contour provided by the embodiment of the disclosure. This method adopts an Automatic Gain Control (AGC) algorithm and a static low-frequency enhancement algorithm, so that the method for dynamically enhancing a low frequency based on equal-loudness contour can realize adaptive features and ensure the stability of low-frequency enhancement effect; here, we call the combination of the two algorithms a dynamic low-frequency enhancement algorithm, and name the dynamic low-frequency enhancement algorithm Grandsun Bass (GASS). Refer to FIG. 1, the implementation flow of the method is described below in detail.

In S101: collecting an input original audio signal.

In S102: extracting a high-frequency signal and a low-frequency signal from the input original audio signal through frequency division to transmit respectively, and reserving one duplicate signal of original audio signal.

In this embodiment, the low-frequency signal is a low-frequency band pure tone signal with frequency less than or equal to 130 HZ in the input audio signal, and the high-frequency signal is a high-frequency band pure tone signal with frequency greater than or equal to 1500 HZ in the input audio signal; in this embodiment, the low-frequency signal, the high-frequency signal and the original audio signal obtained after the frequency-division processing are correspondingly transmitted through three paths of different bandpass filters, respectively.

In S103: performing dynamic gain processing on the low-frequency signal adopting an AGC algorithm, and performing low-pass filtering for the original audio signal and enhancing the filtered original audio signal adopting a static low-frequency enhancement algorithm.

In this embodiment, since the AGC algorithm will perform gain adjustment for the full frequency domain, the low-frequency signal is extracted before the low-frequency enhancement is performed on the input original audio signal, to prevent the AGC algorithm enhancing the high-frequency signal in the input original audio signal concurrently, so that different gains can be superposed for pure tones of different frequencies on the equal-loudness contour. In this embodiment, when performing low-pass filtering for the original audio signal and enhancing the filtered original audio signal adopting a static low-frequency enhancement algorithm, the gain applied to the original audio signal subjected to low-pass filtering is 18 dB(A); of course, in other embodiments, the gain may be adjusted as actually needed.

Figure 2:
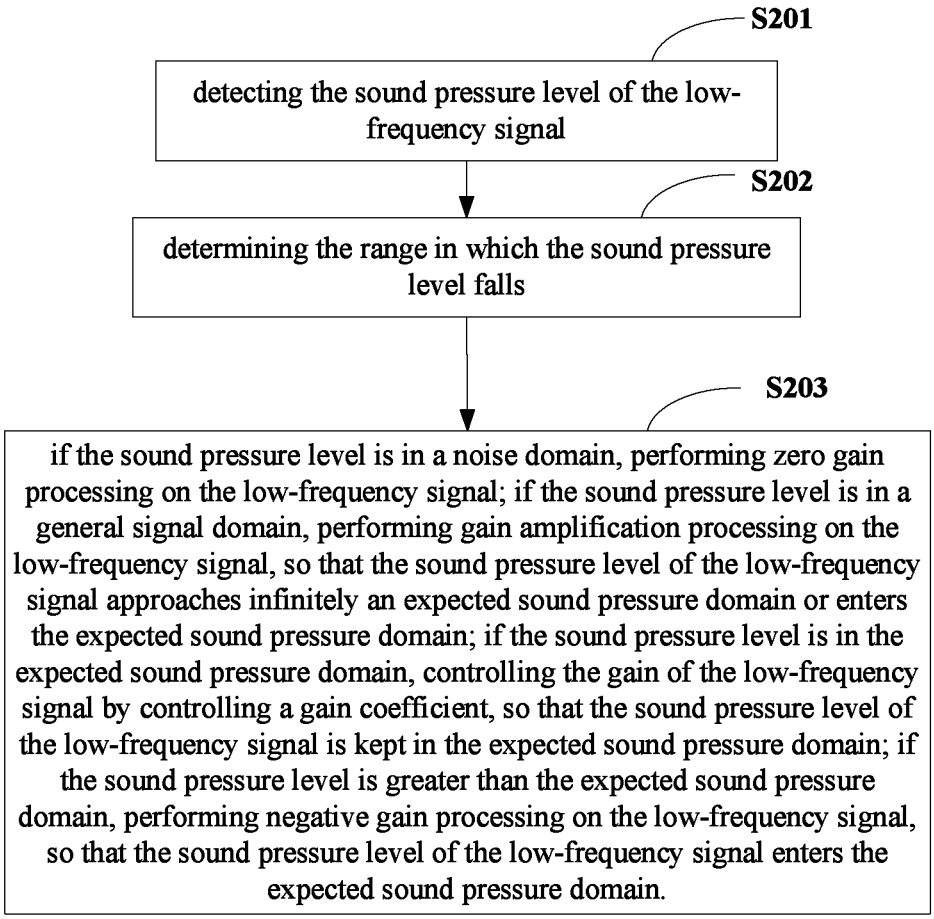
FIG. 2 is a specific flowchart of 5103 of the method for dynamically enhancing a low frequency based on equal-loudness contour provided by the embodiment of the disclosure.

Further, the process of performing dynamic gain processing on the low-frequency signal adopting an AGC algorithm is as shown in FIG. 2.

In S201: detecting the sound pressure level of the low-frequency signal.

In this embodiment, a sound pressure meter is adopted to detect the sound pressure level of the low-frequency signal.

In S202: determining the range in which the sound pressure level falls.

In this embodiment, the sound pressure level includes a noise domain, a general signal domain and an expected sound pressure domain, wherein the range of the sound pressure level of the noise domain is less than or equal to −80 dB(A), the range of the sound pressure level of the general signal domain is −80 dB(A) to −56 dB(A), and the range of the sound pressure level of the expected sound pressure domain is −56 dB(A) to 24 dB(A).

In S203: if the sound pressure level is in a noise domain, performing zero gain processing on the low-frequency signal; if the sound pressure level is in a general signal domain, performing gain amplification processing on the low-frequency signal, so that the sound pressure level of the low-frequency signal infinitely closes to an expected sound pressure domain or enters the expected sound pressure domain; if the sound pressure level is in the expected sound pressure domain, controlling the gain of the low-frequency signal by controlling a gain coefficient, so that the sound pressure level of the low-frequency signal is kept in the expected sound pressure domain; if the sound pressure level is greater than the expected sound pressure domain, performing negative gain processing on the low-frequency signal, so that the sound pressure level of the low-frequency signal enters the expected sound pressure domain. Further, the expected sound pressure domain in this embodiment may be divided into two ranges, including: −56 dB(A) to 12 dB(A) and 12 dB(A) to 24 dB(A); when the sound pressure level of the low-frequency signal is in the area of −56 dB(A) to 12 dB(A), a gain coefficient greater than 1 is adopted to perform gain processing on the low-frequency signal, so that the sound pressure level of the low-frequency signal infinitely closes to 12 dB(A); when the sound pressure level of the low-frequency signal is in the range of 12 dB(A) to 24 dB(A), a gain coefficient less than 1 is adopted to perform gain processing on the low-frequency signal, so that the sound pressure level of the low-frequency signal is always kept in the expected sound pressure domain.

In this embodiment, the AGC algorithm can add different gains to the low-frequency signal according to the range which the sound pressure level of the low-frequency signal falls in, so that the gain applied to the low-frequency signal can be dynamically adjusted according to the change of voice volume when a user adjusts the voice volume, and different gains can be superposed for the low-frequency signal at different sound pressure levels.

In S104: subjecting the high-frequency signal, the processed low-frequency signal and the processed original audio signal to weighted summation to obtain a final output audio signal, the weight coefficients of the high frequency signal, the processed low-frequency signal and the processed original audio signal being a, b and c respectively, where the values of a, b and c range from 0 to 1, and $a+b+c=1$.

In this embodiment, the weight coefficients a, b, c of the high frequency signal, the processed low-frequency signal and the processed original audio signal all have a value of ⅓. It should be understood that we can set the weights of a, b and c again according to specific conditions in other embodiments.

The method for dynamically enhancing a low frequency based on equal-loudness contour provided by the embodiment of the disclosure first performs frequency division for the input audio signal before enhancing the low frequency, thus being capable of preventing enhancing the high-frequency signal in the input original audio signal concurrently, and being capable of achieving the effect of adding different gains to signals of different frequencies; since the AGC algorithm is adopted to perform dynamic gain processing on the low-frequency signal, the gain applied to the low-frequency signal can be dynamically adjusted according to the change of voice volume when a user adjusts the voice volume, and the dynamic nature of GASS is realized; since the static low-frequency enhancement algorithm is adopted to process low-pass filtering enhancement processing on the original audio signal, and, the high-frequency signal, the processed low-frequency signal and the processed original audio signal are subjected to weighted summation to obtain a final output audio signal, so that gains of signals of different frequencies in the output audio signal all meet the tendency of a equal-loudness contour when the voice volume is adjusted, an optimal low-frequency enhancement effect can be achieved, and the stability of the low-frequency enhancement effect can be ensured.

Figure 3:
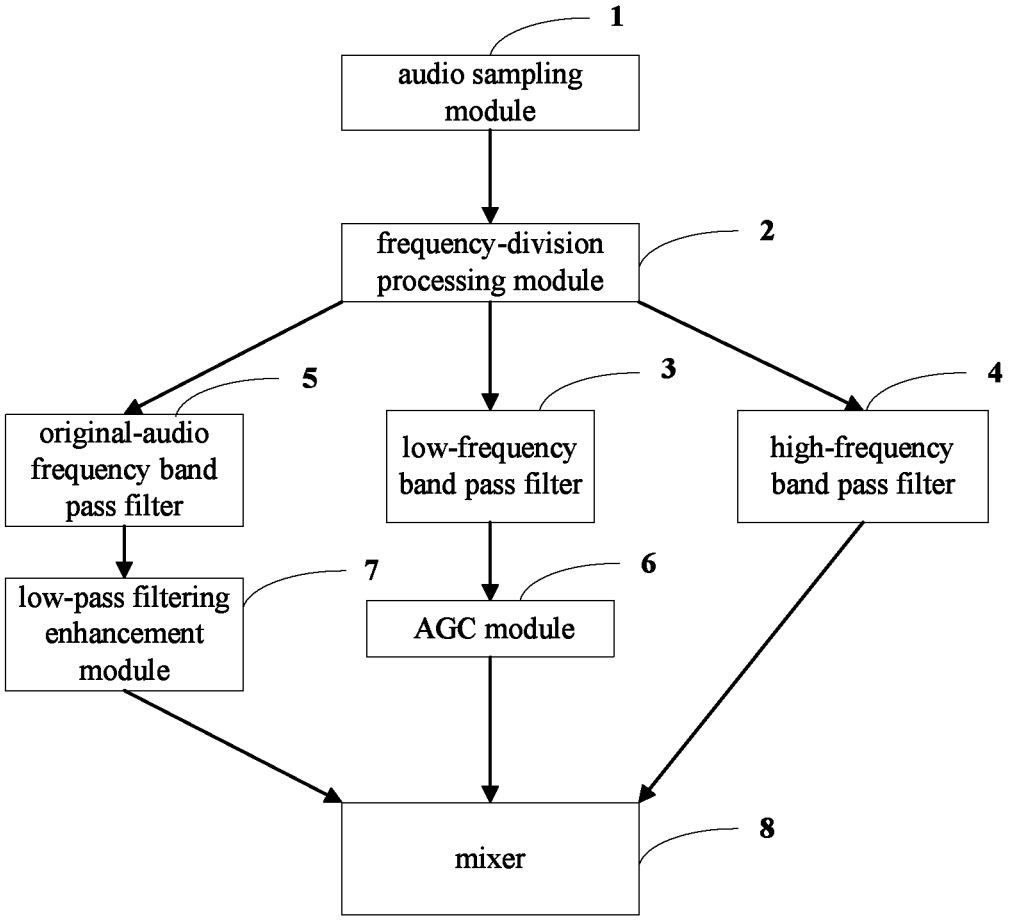
FIG. 3 is a structure diagram of a system for dynamically enhancing a low frequency based on equal-loudness contour provided by the embodiment of the disclosure.

FIG. 3 is a structure diagram of a system for dynamically enhancing a low frequency based on equal-loudness contour provided by the embodiment of the disclosure; the system is configured to run the method for dynamically enhancing a low frequency based on equal-loudness contour described in embodiments shown in FIG. 1 to FIG. 2. For convenient description, only relevant part of this embodiment is illustrated below.

Refer to FIG. 3, the system includes an audio sampling module 1, a frequency division module 2, a low-frequency bandpass filter 3, a high-frequency bandpass filter 4, an original audio bandpass filter 5, an AGC module 6, a filtering and enhancing module 7 and a mixer 8; an input end, a low-frequency output end, a high-frequency output end and an original audio output end of the frequency division module 2 are respectively connected to the audio sampling module 1, the low-frequency bandpass filter 3, the high-frequency bandpass filter 4 and the original audio bandpass filter 5 correspondingly; the low-frequency bandpass filter 3 is further connected to the mixer 8 through the AGC module 6, the high-frequency bandpass filter 4 is directly connected to the mixer 8, and the original audio bandpass filter 5 is connected to the mixer 8 through the filtering and enhancing module 7; herein The audio sampling module 1 is configured to collect an input original audio signal.

The frequency division module 2 is configured to extract a high-frequency signal and a low-frequency signal from the input audio signal through frequency division to transmit respectively through the low-frequency bandpass filter 3 and the high-frequency bandpass filter 4, and reserve one duplicate signal of original audio signal to transmit through the original audio bandpass filter 5. In this embodiment, the low-frequency signal is a low-frequency band signal with frequency less than or equal to 130 HZ in the input original audio signal, and the high-frequency signal is a high-frequency band signal with frequency greater than or equal to 1500 HZ in the input original audio signal.

The AGC module 6 is configured to perform dynamic gain processing on the low-frequency signal adopting an AGC algorithm.

The filtering and enhancing module 7 is configured to perform low-pass filtering enhancement processing on the original audio signal adopting a static low-frequency enhancement algorithm. In this embodiment, when the filtering and enhancing module 7 performs low-pass filtering enhancement processing on the original audio signal, the gain applied to the original audio signal subjected to low-pass filtering is 18 dB(A); of course, in other embodiments, the gain may be adjusted as actually needed.

The mixer 8 is configured to subject the high-frequency signal, the processed low-frequency signal and the processed original audio signal to weighted summation to obtain a final output audio signal, the weight coefficients of the high frequency signal, the processed low-frequency signal and the processed original audio signal being a, b and c respectively, where the values of a, b and c range from 0 to 1, and a+b+c=1. In this embodiment, the weight coefficients a, b, c of the high frequency signal, the processed low-frequency signal and the processed original audio signal all have a value of ⅓. It should be understood that we can set the weights of a, b and c again according to specific conditions in other embodiments.

Figure 4:
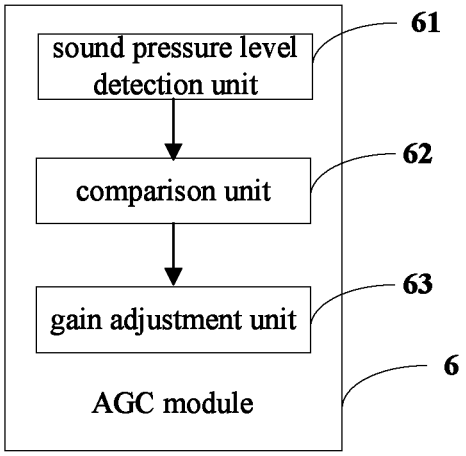
FIG. 4 is a structure diagram of an AGC module in the system for dynamically enhancing a low frequency based on equal-loudness contour provided by the embodiment of the disclosure.

Further, FIG. 4 is a structure diagram of an AGC module in the system for dynamically enhancing a low frequency based on equal-loudness contour provided by the embodiment of the disclosure. For convenient description, only relevant part of this embodiment is illustrated below.

Refer to FIG. 4, the AGC module 6 includes:

a sound pressure level detection unit 61 which is configured to detect the sound pressure level of the low-frequency signal; in this embodiment, the sound pressure level detection unit 61 adopts a sound pressure meter;

a comparison unit 62 which is configured to determine the range which the sound pressure level falls in; in this embodiment, the sound pressure level includes a noise domain, a general signal domain and an expected sound pressure domain, wherein the range of the sound pressure level of the noise domain is less than or equal to −80 dB(A), the range of the sound pressure level of the general signal domain is −80 dB(A) to −56 dB(A), and the range of the sound pressure level of the expected sound pressure domain is −56 dB(A) to 24 dB(A); and a gain adjustment unit 63 which is configured to: if the sound pressure level is in a noise domain, perform zero gain processing on the low-frequency signal; if the sound pressure level is in a general signal domain, perform gain amplification processing on the low-frequency signal, so that the sound pressure level of the low-frequency signal infinitely closes to an expected sound pressure domain or enters the expected sound pressure domain; if the sound pressure level is in the expected sound pressure domain, control the gain of the low-frequency signal by controlling a gain coefficient, so that the sound pressure level of the low-frequency signal is kept in the expected sound pressure domain; if the sound pressure level is greater than the expected sound pressure domain, perform negative gain processing on the low-frequency signal, so that the sound pressure level of the low-frequency signal enters the expected sound pressure domain.

The system for dynamically enhancing a low frequency based on equal-loudness contour provided by the embodiment of the disclosure first performs frequency division for the input audio signal before enhancing the low frequency, thus being capable of preventing enhancing the high-frequency signal in the input original audio signal concurrently, and being capable of achieving the effect of adding different gains to signals of different frequencies; since the AGC algorithm is adopted to perform dynamic gain processing on the low-frequency signal, the gain applied to the low-frequency signal can be dynamically adjusted according to the change of voice volume when a user adjusts the voice volume, and the dynamic nature of GASS is realized; since the low-pass filtering enhancement processing module is adopted to process low-pass filtering enhancement processing on the original audio signal, and, the high-frequency signal, the processed low-frequency signal and the processed original audio signal are subjected to weighted summation through the mixer to obtain a final output audio signal, so that gains of signals of different frequencies in the output audio signal all meet the tendency of a equal-loudness contour when the voice volume is adjusted, an optimal low-frequency enhancement effect can be achieved, and the stability of the low-frequency enhancement effect can be ensured.

The above are preferred embodiments of the disclosure merely, and are not intended to limit the disclosure. Any modifications, equivalent substitutes and improvements, etc., made within the spirit and principle of the disclosure all are intended to be included in the protection scope of the present invention.

What is claimed is:

1. A method for dynamically enhancing a low frequency based on an equal-loudness contour, comprising:

receiving an input audio signal;

extracting a high-frequency signal and a low-frequency signal from the input audio signal through frequency division, and maintaining a duplicate signal of the input audio signal as an original audio signal;

performing dynamic gain processing on the low-frequency signal by using an AGC algorithm to generate a processed low-frequency signal, and performing low-pass filtering for the original audio signal and enhancing the filtered original audio signal by using a static low-frequency enhancement algorithm to generate a processed original audio signal; and subjecting the high-frequency signal, the processed low-frequency signal and the processed original audio signal to weighted summation to obtain a final output audio signal;

wherein performing dynamic gain processing on the low-frequency signal by using the AGC algorithm comprises:

detecting a sound pressure level of the low-frequency signal;

determining a range of a noise domain, a general signal domain and an expected sound pressure domain respectively and determining the domain the sound pressure level falls into; and if the sound pressure level of the low-frequency signal falls into the noise domain, performing zero gain processing on the low-frequency signal;

if the sound pressure level of the low-frequency signal falls into the general signal domain, performing gain amplification processing on the low-frequency signal, so that the sound pressure level of the low-frequency signal is substantially within the expected sound pressure domain or enters into the expected sound pressure domain;

if the sound pressure level of the low-frequency signal falls into the expected sound pressure domain, controlling the gain of the low-frequency signal by controlling a gain coefficient, so that the sound pressure level of the low-frequency signal is kept within the expected sound pressure domain;

if the sound pressure level of the low-frequency signal goes beyond the expected sound pressure domain, performing negative gain processing on the low-frequency signal, so that the sound pressure level of the low-frequency signal enters into the expected sound pressure domain.

2. The method according to claim 1, wherein, the range of the sound pressure level of the noise domain is less than or equal to −80 dB(A), the range of the sound pressure level of the general signal domain is from −80 dB(A) to −56 dB(A), and the range of the sound pressure level of the expected sound pressure domain is from −56 dB(A) to 24 dB(A).

3. The method according to claim 1, wherein weight coefficients of the high-frequency signal, the processed low-frequency signal and the processed original audio signal are represented by a, b and c respectively, and the weight coefficients a, b, c all have a value of ⅓.

4. The method according to claim 1, wherein, the low-frequency signal is a low-frequency band pure tone signal with a frequency less than or equal to 130 HZ in the input audio signal, and the high-frequency signal is a high-frequency band pure tone signal with a frequency greater than or equal to 1500 HZ in the input audio signal.

5. The method according to claim 1, wherein, the expected sound pressure domain is divided into two ranges comprising one from −56 dB(A) to 12 dB(A) and another from 12 dB(A) to 24 dB(A); wherein the method, if the sound pressure level of the low-frequency signal falls into the expected sound pressure domain, further comprises:

performing gain processing on the low-frequency signal by adopting the gain coefficient greater than 1 if the sound pressure level of the low-frequency signal falls into the range of from −56 dB(A) to 12 dB(A), such that the sound pressure level of the low-frequency signal closes to 12 dB(A); or performing gain processing on the low-frequency signal by adopting the gain coefficient less than 1 if the sound pressure level of the low-frequency signal falls into the range of from 12 dB(A) to 24 dB(A), such that the sound pressure level of the low-frequency signal is always kept within the expected sound pressure domain.

6. The method according to claim 1, wherein, the processed low-frequency signal, the high-frequency signal and the processed original audio signal are correspondingly transmitted through three different bandpass filters, respectively.

7. A system for dynamically enhancing a low frequency based on an equal-loudness contour, comprising:

an audio sampling module configured to receive an input audio signal;

a low-frequency bandpass filter;

a high-frequency bandpass filter;

an original audio bandpass filter configured to output a processed original audio signal;

a frequency division module configured to extract a low-frequency signal provided to the low-frequency bandpass filter and a high-frequency signal provided to the high-frequency bandpass filter from the input audio signal through frequency division, and to maintain a duplicate signal of the input audio signal as an original audio signal that is provided to the original audio bandpass filter;

an AGC module configured to perform dynamic gain processing on the low-frequency signal by using an AGC algorithm to generate a processed low-frequency signal;

a filtering and enhancing module configured to perform low-pass filtering for the original audio signal and enhance the filtered original audio signal by using a static low-frequency enhancement algorithm; and a mixer configured to subject the high-frequency signal, the processed low-frequency signal and the processed original audio signal to weighted summation to obtain a final output audio signal;

wherein an input end, a low-frequency output end, a high-frequency output end and an original audio output end of the frequency division frequency division module are respectively connected to the audio sampling module, the low-frequency bandpass filter, the high-frequency bandpass filter and the original audio bandpass filter correspondingly; wherein the low-frequency bandpass filter is further connected to the mixer through the AGC module, and the high-frequency bandpass filter is directly connected to the mixer, and the original audio bandpass filter is connected to the mixer through the filtering and enhancing module;

wherein the AGC module comprises:

a sound pressure level detection unit configured to detect a sound pressure level of the low-frequency signal;

a comparison unit configured to determine a range of a noise domain, a general signal domain and an expected sound pressure domain respectively and to determine the domain the sound pressure level falls into; and a gain adjustment unit;

wherein the gain adjustment unit is configured to:

perform zero gain processing on the low-frequency signal, if the sound pressure level of the low-frequency signal falls into the noise domain;

perform gain amplification processing on the low-frequency signal, so that the sound pressure level of the low-frequency signal is substantially within the expected sound pressure domain or enters into the expected sound pressure domain, if the sound pressure level of the low-frequency signal falls into the general signal domain;

control the gain of the low-frequency signal by controlling a gain coefficient, so that the sound pressure level of the low-frequency signal is kept in the expected sound pressure domain, if the sound pressure level falls into the expected sound pressure domain;

perform negative gain processing on the low-frequency signal, so that the sound pressure level of the low-frequency signal enters into the expected sound pressure domain, if the sound pressure level goes beyond the expected sound pressure domain.

8. The system according to claim 7, wherein the range of the sound pressure level of the noise domain is less than or equal to −80 dB(A), the range of the sound pressure level of the general signal domain is from −80 dB(A) to −56 dB(A), and the range of the sound pressure level of the expected sound pressure domain is from −56 dB(A) to 24 dB(A).

9. The system according to claim 7, wherein weight coefficients of the high-frequency signal, the processed low-frequency signal and the processed original audio signal are represented by a, b and c respectively, and the weight coefficients a, b, c all have a value of ⅓.

10. The system according to claim 7, wherein, the low-frequency signal is a low-frequency band signal with a frequency less than or equal to 130 HZ in the input audio signal, and the high-frequency signal is a high-frequency band signal with a frequency greater than or equal to 1500 HZ in the input audio signal.

11. The system according to claim 7, wherein the expected sound pressure domain is divided into two ranges, including: comprising one from −56 dB(A) to 12 dB(A) and another from 12 dB(A) to 24 dB(A); wherein the gain adjustment unit, if the sound pressure level falls into the expected sound pressure domain, is further configured to:

adopt the gain coefficient greater than 1 to perform gain processing on the low-frequency signal if the sound pressure level of the low-frequency signal falls into the range of from 56 dB(A) to 12 dB(A), such that the sound pressure level of the low-frequency signal closes to 12 dB(A); or adopt the gain coefficient less than 1 to perform gain processing on the low-frequency signal if the sound pressure level of the low-frequency signal falls into the range of from 12 dB(A) to 24 dB(A), such that the sound pressure level of the low-frequency signal is always kept within the expected sound pressure domain.

12. The system according to claim 7, wherein the processed low-frequency signal, the high-frequency signal and the processed original audio signal are correspondingly transmitted through three different bandpass filters, respectively.

* * * * *